US011649942B1

(12) United States Patent
Petrone

(10) Patent No.: US 11,649,942 B1
(45) Date of Patent: May 16, 2023

(54) ALBUM COVER LAMP

(71) Applicant: Nancy Petrone, Wheaton, IL (US)

(72) Inventor: Nancy Petrone, Wheaton, IL (US)

( * ) Notice: Subject to any disclaimer, the term of this patent is extended or adjusted under 35 U.S.C. 154(b) by 0 days.

(21) Appl. No.: 17/824,736

(22) Filed: May 25, 2022

(51) Int. Cl.

| | |
|---|---|
| ***F21V 3/04*** | (2018.01) |
| ***F21V 17/10*** | (2006.01) |
| ***F21V 23/04*** | (2006.01) |
| ***F21V 23/00*** | (2015.01) |
| ***F21S 6/00*** | (2006.01) |
| ***F21V 21/40*** | (2006.01) |

(52) U.S. Cl.
CPC ..... *F21V 3/04* (2013.01); *F21S 6/002* (2013.01); *F21S 6/005* (2013.01); *F21V 17/101* (2013.01); *F21V 21/40* (2013.01); *F21V 23/002* (2013.01); *F21V 23/04* (2013.01)

(58) Field of Classification Search
CPC ..... F21S 6/002; F21S 6/005; F21V 23/002; F21V 21/40
See application file for complete search history.

(56) References Cited

U.S. PATENT DOCUMENTS

| | | | | |
|---|---|---|---|---|
| 6,113,249 | A * | 9/2000 | Ziegler | A47G 1/14 362/253 |
| 7,347,593 | B1 * | 3/2008 | Swanson | F21V 1/26 362/357 |
| 10,060,595 | B1 * | 8/2018 | Martin | F21S 6/002 |
| 10,344,928 | B1 * | 7/2019 | Leddusire | F21S 8/036 |
| 2014/0153258 | A1 * | 6/2014 | Swanson | F21V 23/002 362/363 |
| 2018/0045398 | A1 * | 2/2018 | Tsai | F21V 3/10 |

* cited by examiner

*Primary Examiner* — William N Harris
(74) *Attorney, Agent, or Firm* — James D Palmatier; Applied Patent Services, PC

(57) ABSTRACT

The invention is an album cover lamp comprising a lamp having a body and a light assembly. An album cover, such as provided when purchasing a vinyl music album is adhesively attached to the body having a design side facing outward from the body. The handle and light assembly may comprise a plumbing type piping arrangement on the side and top of the body having a cord passageway extend from the handle to the light assembly.

3 Claims, 3 Drawing Sheets

ALBUM COVER LAMP

FIELD OF THE INVENTION

The album cover lamp relates generally to a unique method of making a lamp out of a record album cover and a lamp made by the method.

BACKGROUND OF THE INVENTION

The inventor has come to realize from their own experience that there may be a tremendous amount of iconic art used on record album covers. As the music industry advanced from 1950 to 1990 and to today, record albums, generally pressed from vinyl were widely used to record and distribute music. Early records were encased in paper or cardboard covers to protect the vinyl record. These covers were imprinted with pictures of the artists and later with art work ranging from pictures to drawings and paintings depicting art that became synonymous with the artists or the music. The industry advanced to other mediums of music distribution such as cassette tapes, compact discs and digital media while continuing to use images of a timely reflection on present culture. The album cover lamp utilizes the cover of vinyl records to create a lamp with artistry representing iconic musicians and music. The album covers are formed as a pocket closed on three sides. The album cover may be stripped of the contents and two of the three sides adjacent to the opening cut to allow the front of the album cover and the back to be opened to a single layer flat configuration. The album cover is formed over a lamp body in an orientation to decorate the lamp body and showcase this iconic artwork. Excess album cover material may be trimmed from the top, bottom and a side to cover the lamp body without overlap.

It is desired to provide a lamp having a body covered by an album cover. This preserves the artwork and provides special meaning to the user of the lamp.

BRIEF OVERVIEW OF THE INVENTION

The album cover lamp comprises a lamp having a base, a body, a light assembly and a bulb. The body may be disposed between the base and the light assembly. The body comprises a multi-sided core comprising a core top, a core bottom, and a plurality of sides. The album cover comprises a front side, a back side, a bottom edge, a top edge, a left edge, a right edge. A bulb is in the light assembly. The lamp further comprises a cord passageway extending through the body to the light assembly having an electrical cord therein to facilitate providing electricity to the bulb. A switch may be in the light assembly. The switch attached electrically to the bulb and the electrical cord. The switch adapted to connect and disconnect the bulb from an electrical cord in the cord passage. The album cover back may be on one or more of the plurality of core sides, whereby the outside of album cover front side is displayed between the base and the light assembly.

The core comprises a multi-sided block The album cover is typically rectangular and formed in a sleeve configuration of a sheet folded over having the sides attached to each other by seams disposed along the two pairs of adjoining edges and an opening along one edge. The seams are cut to open the album cover to a flat configuration. The album cover comprises a front side, a back side, a top edge, a bottom edge, a left edge and a right edge. The art work is generally on the front side. The back side may be glued to the core having the art work facing outward from the body.

The album cover lamp may be created using the following steps:

Provide an album cover 18 having top, a front and a back, the album cover further comprising artwork on the front;

Provide a core comprising a wooden 4×4 approximately 12" long, the core comprising a top and a bottom and an outer surface;

Sand the top and bottom of the core to smooth both surfaces;

Spray paint the core outer surface with paint and primer;

Dispose adhesive on outer surface;

Dispose album cover back on outer surface having album cover top adjacent to core top;

Glue back onto outer surface with adhesive there-between to affix album cover to core with adhesive;

Remove excess portion of album cover 18 at core top, core bottom and any overlap of back onto front;

Drill side hole in a back side of core approximately halfway through;

Drill top hole in core top extending approximately halfway to core bottom;

Join side hole to top hole;

Attach a side piping unit by:

Provide first black steel pipe section, first black steel pipe elbow and first hanger, first black steel pipe section comprising first pipe end and second pipe opening, first black steel pipe elbow comprising first and second opening;

Connect first hangar to body adjacent to side hole;

Connect first end of the first black steel pipe section to first opening;

Attach first black steel pipe section to first hanger thereby disposing second opening concentric with side hole to form electric cord passageway extending from second end to top hole;

Attach top piping unit by providing first flange, second and third elbows and second black steel pipe spacer, first flange comprising a center hole;

Attach first flange to body top having flange center hole concentric with and in fluid communication with top hole;

Attach second elbow to first flange;

Attach second steel pipe spacer to second elbow;

Attach third elbow to second steel pipe spacer;

Provide light assembly with light bulb attached; and

Attach light assembly to third elbow.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION OF THE INVENTION

Figure 1:
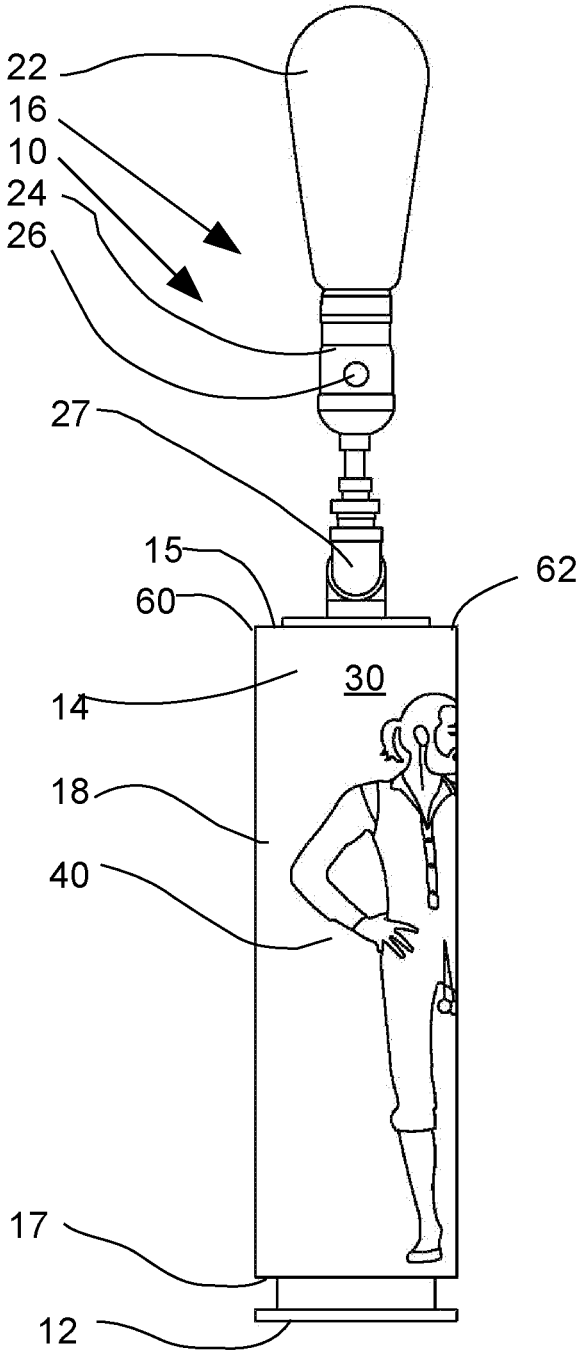
FIG. 1 is a front elevation view of a album cover lamp comprising a Fleetwood Mac, Rumors, album cover front on the body.
Figure 2:
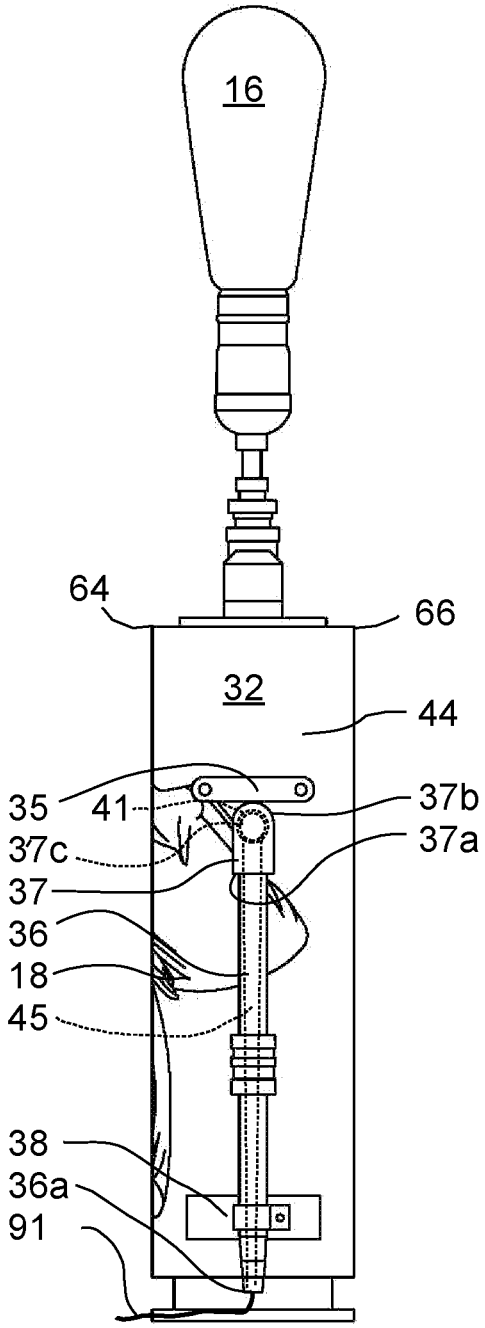
FIG. 2 is a back elevation view thereof.
Figure 3:
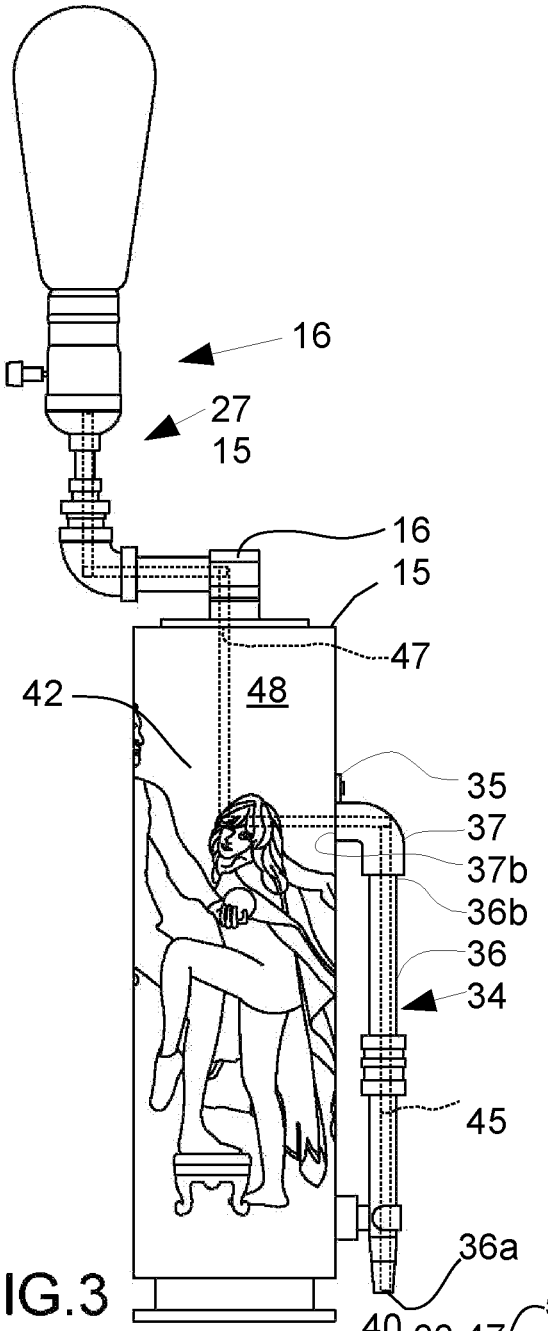
FIG. 3 is a right side elevation view thereof.
Figure 4:
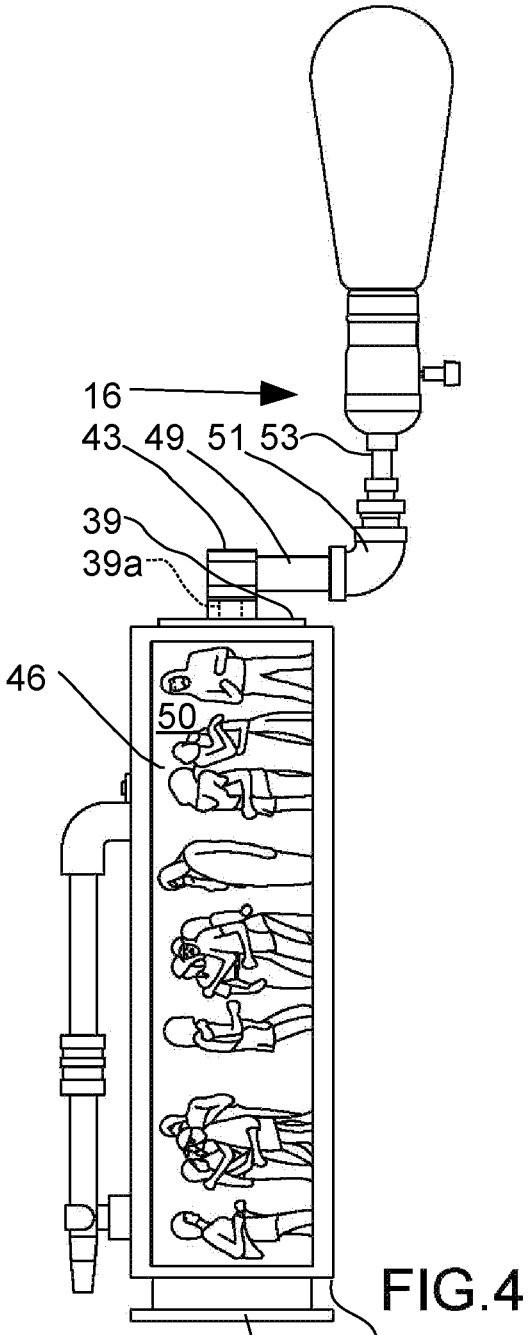
FIG. 4 is a left side elevation view thereof.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. (It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting.) It should be appreciated that the invention can be used for any suitable device attachable to a magnetic surface, Referring to FIGS. 1-4, the album cover lamp 10 may comprise a base 12, a body 14 and a light assembly 16. The base 12 may be adapted to hold the body 14 in spaced relation to a table or shelf (not shown). The body 14 may comprise a body front side 30, a body back side 32, a right side 42, a body left side 46, body top 15 and body bottom 17. The light assembly 16 may comprise a bulb 22 a socket 24, a switch 26 and a top piping unit 27. A handle 34 may be disposed on the body back side 32. The handle 34 may comprise a hollow pipe assembly comprising a mounting bracket 35, a first black steel pipe 36, a hanger 38 and first elbow 37. First black steel pipe 36 may comprise an open end 36*a* and an elbow end 36*b*. First elbow 37 may comprise a first elbow pipe end 37*a* and a first elbow body end 37*b*. Elbow end 36*b* may be attached to first elbow pipe end 37*a*. First elbow body end 37*b* may comprise opening 37*c* disposed concentric to side hole 41. Hanger 38 may be attached to back side 32. First black steel pipe 36 may be attached to hanger 38 having first elbow body end 37*b* disposed concentric to side hole 41 forming electrical cord passageway 45 from open end 36*a* to top hole 47 and extending to light assembly 16.

Continuing to refer to FIGS. 1-4, top piping unit 27 may be attached to light assembly 16 and body 14. Top piping unit 27 may comprise flange 39 having threaded center hole 39*a*, second elbow 43, spacer pipe 49, third elbow 51 and stem 53. Flange 39 may be disposed on body top 15 having center hole 39*a* concentric with top hole 47. Spacer pipe 49 maybe attached to second elbow 43 and third elbow 51. Second elbow 43 may be attached to flange 39. Stem 53 may be attached to third elbow 51. Light assembly 16 may be disposed on third elbow extending electrical cord passageway 45 from top hole 47 through top piping unit 27 to light assembly 16 whereby electrical cord passageway extends from light assembly 16 through top piping unit 27 and body 14 and handle 34 to open end 36*a*. Electric cord 39 may be adapted to connect electrical source (not shown) to light assembly 16.

Figure 5:
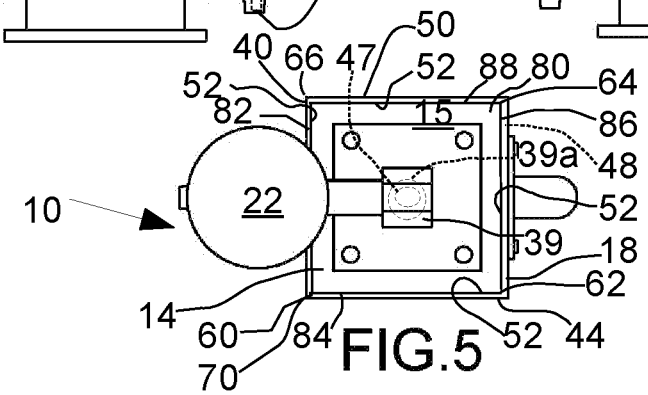
FIG. 5 is a top plan view thereof.

Referring to FIG. 5, the body 14 may comprise a core 80 covered by album cover 18. Core 80 may comprise a first core side 82, a second core side 84, a third core side 86 and a fourth core side 88. The album cover 18 may likewise comprise a first portion 40, a second portion 44, third portion 48 and a fourth portion 50. The first album cover portion 40 may be disposed on the core front 82 and fixed there-to with adhesive 52 disposed between core 80 and album cover 18. Album cover 18 may be formed around core first corner 60, whereby second album cover portion 44 is disposed on core second side 84 with adhesive 52 there-between. Adhesive 52 may be contact cement or concrete cement glue or similar glue for attaching the paper album cover 18 to core 80. Album cover 18 is bent around core second corner 62 thereby disposing the third album cover portion 48 on core third side 86. Album cover 18 is bent over core third corner 64 thereby disposing the fourth album cover portion 50 on core fourth side 88. Album cover 18 may be fixed to core 80 by adhesive 52 disposed there-between thereby surrounding the core 80. Excess album cover 18 may be trimmed at fourth corner 66 to reduce overlap of album cover 18 on itself.

Figure 6:
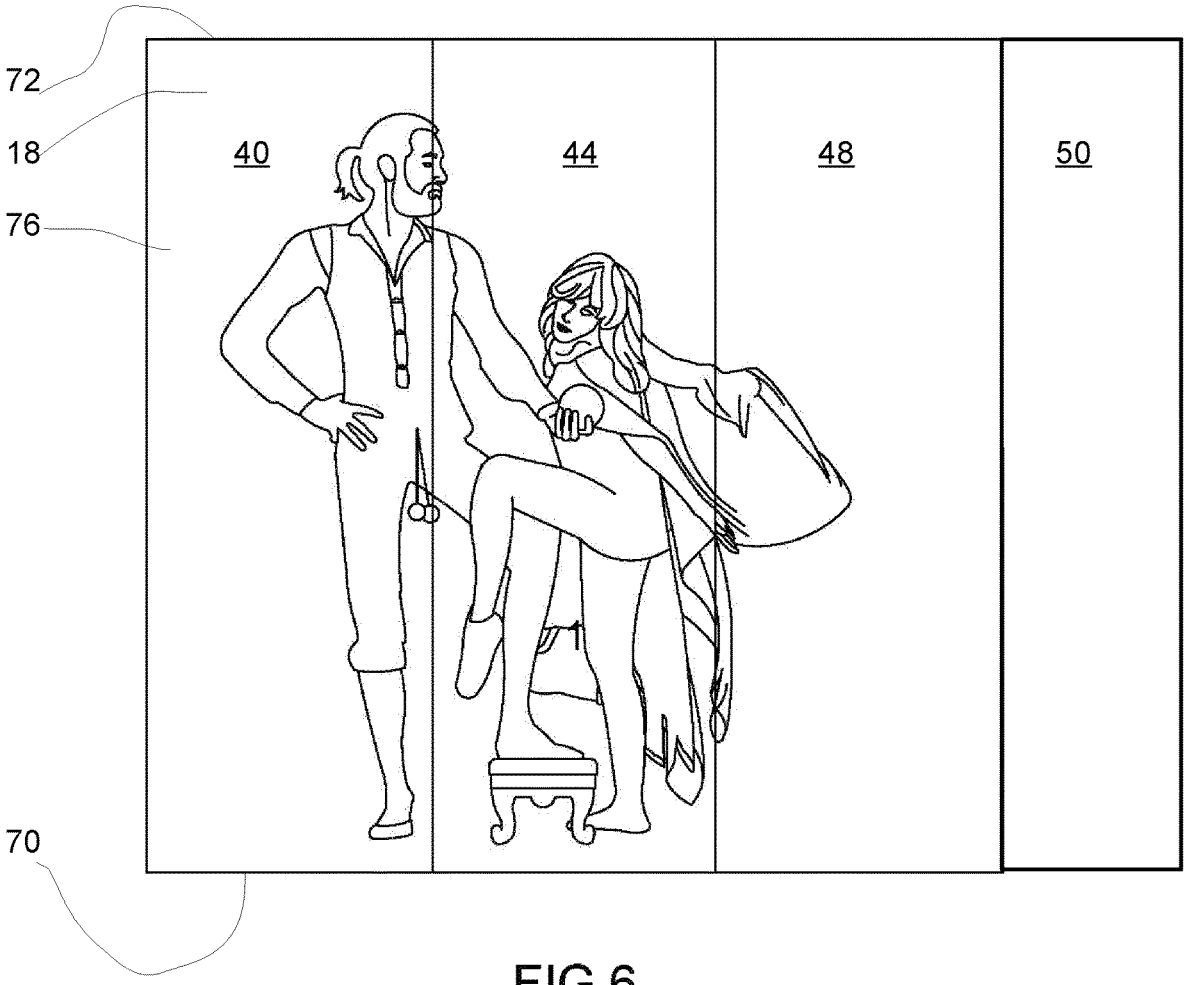
FIG. 6 is a front elevation view of the outside of the album cover front side.
Figure 7:
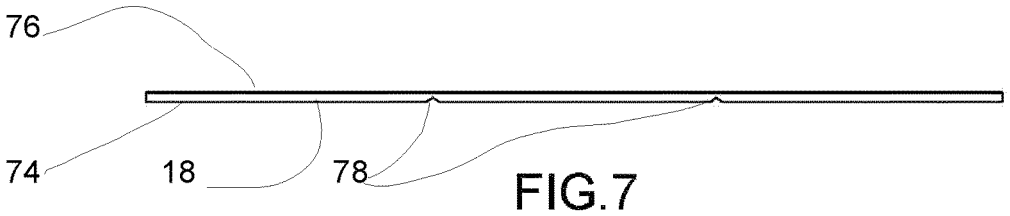
FIG. 7 is a top plan view of the album cover of FIG. 6.

Referring to FIGS. 6 and 7, album cover 18 may comprise a bottom side 70, a top side 72, in inside 74 and a design side 76. The album cover 18 may be adapted to comprise a plurality of portions including a first album cover portion 40, second album cover portion 44, third album cover portion 48, and fourth album cover portion 50. Notches 78 may be scored on the album cover inside 74.

Referring to FIGS. 1-7, to assemble lamp 10 the steps of the method to create the album cover lamp include:

1. Provide a square core 80;
2. Provide a record album cover 18, said record album cover comprising an album cover front 74 and an album cover back 76, album cover further comprising a first portion 40, second portion 44, third portion 48 and a fourth portion 50;
3. Apply adhesive 50 to the core 80;
4. Dispose the first album cover portion 40 on the core first side 82, having the adhesive 52 between the album cover back 76 and the core 80;
5. Bend the album cover 18 around the core 80 to urge the second album cover portion 42 to bear against the second core side 84;
6. Dispose the second album cover portion 42 on the core second side 84 having the adhesive 52 between the album cover back 74 and the core 80;
7. Bend the album cover 18 around the core 80 to urge the third album cover portion 48 to bear against the core third side 86;
8. Dispose the third album cover portion 48 on the core second side 86 having the adhesive 52 between the album cover back 74 and the core 80;
9. Bend the album cover 18 around the body to urge the fourth album cover portion 50 to bear against the core fourth side 88;
10. Dispose the fourth album cover portion 50 on the core 80 having the adhesive 52 between the album cover back 74 and the core 80;
11. Drill side hole 41;
12. Drill top hole 47;
13. Attach a handle 34 by providing bracket 35, first black steel pipe section 36, first black steel pipe elbow 37 and hanger 38, first black steel pipe 36 comprising open end 36*a* and elbow end 36*b*. First black steel pipe elbow 37 comprising pipe end 37*a* and first elbow body end 37*b* and first elbow body opening 37*c;*

14. Connect hanger 38 and bracket 35 to body 18 in spaced relation having bracket adjacent to side hole 41, hanger between bracket and base 12;
15. Connect pipe elbow end 36*b* to first elbow pipe end 37*a;*
16. Attach first black steel pipe section 36 to first hanger 38 having first elbow body opening 37*c* generally concentric with side hole 41 whereby open end 36*a* is in fluid communication with side hole 41;
17. Attach top piping unit 92 to top 15;
18. Provide flange 39, second and third elbows 43, 51, stem 53 and black steel pipe spacer 49, first flange comprising a center hole 39*a;*
19. Attach flange 39 to body top 15 having flange center hole 39*a* concentric with and in fluid communication with top hole 47;
20. Attach second elbow 43 to flange 39;
21. Attach second steel pipe spacer 49 to second elbow 43;
22. Attach third elbow 51 to second steel pipe spacer 49;
23. Attach spacer to third elbow 51;
24. Provide light assembly 16 with light bulb 22 attached;
25. Attach light assembly 16 to stem 53;
26. Provide an electric cord 91;
27. Dispose electric cord 91 in electrical passageway 45;
29. Attach electric cord 91 to light assembly 16.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

I claim:

1. An album cover lamp comprising:

a body, the body comprising a core and a base, the core comprising a core top, a core bottom, a first core side, a second core side, a third core side, and a fourth core side, a side hole in the third core side, a top hole in the core top, the top hole in fluid communication with the side hole, and adhesive on each of the first, second, third, and fourth core sides;

a light assembly, the light assembly comprising a flange, a first elbow, a spacer, a second elbow, and a socket, the flange comprising a center hole extending there through, the center hole in fluid communication with the top hole, the first elbow on the flange, the first elbow comprising a first hollow interior, the first hollow interior in fluid communication with the center hole, the spacer on the first elbow, the spacer comprising a cord passageway, the cord passageway in fluid communication with the first hollow interior, the second elbow on the spacer, the second elbow comprising a second hollow interior, the second hollow interior in fluid communication with the cord passageway, the socket comprising a switch, the socket on the second elbow, the switch in fluid communication with the second hollow interior, whereby the socket is in fluid communication with the side hole; and an album cover, the album cover comprising a design, an album cover back side, an album cover front side, an album cover top, and an album cover bottom, the design on the front side, the album cover back side disposed on the core, and adhesive on the back side adapted to hold the album cover on the core whereby the album cover is attached to the body having the design spaced from the core.

2. The album cover lamp of claim 1, further comprising a handle, the handle comprising a pipe, a hanger, and a third elbow, the hanger on the body, the pipe on the hanger, the third elbow on the pipe, the third elbow disposed adjacent to the side hole, the cord passageway extending through the third elbow and the pipe to a second end of the pipe whereby the cord passageway extends from the second end to the top hole.

3. A method of making an album cover lamp comprising the steps:

provide an album cover, the album cover comprising a front and back and a design, the design on the front;

provide a core, the core comprising a core top, a core bottom, and a plurality of sides;

spray paint the plurality of sides with paint and primer;

drill a top hole in a center of the core top, the top hole extending toward the bottom;

dispose the album cover back on the core between the core top and core bottom;

glue the album cover back to the plurality of sides using adhesive;

remove an excess portion of the album cover, the excess portion being a portion of the album cover which extends beyond the periphery of the core;

drill a side hole in one of the plurality of core sides, and adapt the side hole to be in fluid communication with the top hole;

provide a light socket, a first black steel pipe section, a flange, and first and second steel elbows, the flange comprising center hole extending therethrough, the pipe section comprising a hollow interior;

connect the first black steel pipe section to the first elbow;

connect the first black steel pipe section to the second elbow;

attach the flange to the core top by disposing the center hole to be concentric to the top hole;

attach the first elbow to the flange;

provide a light assembly, the light assembly comprising a switch and a socket;

attach the second elbow to the light assembly whereby a cord passageway extends from a second end of the pipe to the socket.

* * * * *